US006290522B1

(12) United States Patent
Campolo et al.

(10) Patent No.: US 6,290,522 B1
(45) Date of Patent: Sep. 18, 2001

(54) FLUORESCENT LAMPHOLDER

(75) Inventors: Steve Campolo, Malverne; Paul Endres, Plainview; Gerald N. King, Deer Park, all of NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 09/490,738

(22) Filed: Jan. 25, 2000

Related U.S. Application Data

(63) Continuation-in-part of application No. 09/026,077, filed on Feb. 19, 1998.

(51) Int. Cl.[7] ..... H01R 33/08
(52) U.S. Cl. ..... 439/241; 439/244
(58) Field of Search ..... 439/226, 232, 439/242, 243, 244, 612, 613, 237, 241; 362/217, 260

(56) References Cited

U.S. PATENT DOCUMENTS 3,351,884 * 11/1967 Pistey ..... 439/232
3,359,414 * 12/1967 Ege ..... 439/244
3,818,418 * 6/1974 Detch ..... 439/226
4,994,710 * 2/1991 Roelevink et al. ..... 439/226

* cited by examiner

*Primary Examiner*—Brian Sircus
*Assistant Examiner*—Chandrika Prasad
(74) *Attorney, Agent, or Firm*—Paul J. Sutton

(57) ABSTRACT

Lampholders to be used with cold cathode fluorescent lamps of the type that do not require heated internal filaments. A lamp pin contact to engage one of the two lamp pins at each end of the lamp provides the electrical circuit between a high voltage ballast and the gas within the lamp. A lamp retainer device engages one of the lamp pins and cooperates with one lamp pin contact to support the lamp. The device may take the form of one or more cantilever mounted insulating or conductive arms, a flat or spring wire form or may be made of compressible material. A further form of lampholder uses a spring loaded contact to engage the lamp pins of a fluorescent lamp and to make contact with a single power conductor.

29 Claims, 10 Drawing Sheets

FLUORESCENT LAMPHOLDER

This application is a continuation-in-part of U.S. application Ser. No. 09/026,077 filed Feb. 19, 1998.

BACKGROUND OF THE INVENTION

1. Field of the Invention

The invention is directed to lampholders for electrical lamps, and more particularly to lampholders to mechanically support and provide electrical power to fluorescent lamps.

2. Description of the Prior Art

Originally, fluorescent tube lamps were cylindrical glass enclosures or envelopes which contained an ionizable gas. A tungsten filament located at each of the two tube ends required a low voltage from a ballast or "starter" to heat the filament to incandescence to create thermionic emissions so that enough ions were created to ionize the gas. The voltage from the ballast was applied to the filaments via two metallic lamp pins which extended out of each end of the glass tube envelope. The two lamp pins at each end were engaged by lampholders at each end which provided mechanical support and electrical power to the fluorescent lamps.

Later, fluorescent lamps called "cold cathode" lamps were developed that eliminated the need to heat the filament. Instead, a voltage, in the order of 1300 volts, produced by a high-voltage ballast, was applied to the filament to force a sufficient number of tungsten ions from the filament to ionize the gas for ignition However, since the pins also serve with the lampholders as mechanical supports for the fluorescent lamp, and in view of the large number of installed double-contact fluorescent lampholders, a need for fluorescent lamps with two lamp pins at each end continues to exist. Some manufacturers applied an electrical shunt across the two lamp pins at each lamp end, in the belief that the high energizing voltage would need to be evenly distributed across each of the filaments to cause an even dispersion of ions.

FIGS. 1 and 2 show a prior art fluorescent lampholder 10 and the manner in which it was connected to an electrical source. A body 12 fabricated of phenolic, rubber or a suitable plastic is arranged to be placed in a housing, at the ends of a reflector or other similar mounting (not shown). Body 12 has a channel 14 with an entry slot 16 leading from outside body 12 into channel 14. Placed in the open back of body 12 are two lamp pin contacts 18 each intended to engage one of the fluorescent tube pins (not shown) in their notches 22 in the upper portion 20 of lamp pin contacts 18. The lamp pin contacts 18 are assembled to the interior wall of body 12 by fasteners (not shown) extending through an aperture 24 in each of the lamp pin contacts 18. A shunt bar 26 is coupled between the lamp pin contacts 18. The bottom portion 28 of lamp pin contacts 18 are bifurcated as at 30 and provide two coupling tongues 32 which make contact with the bared end of an insulated conductor (not shown). Tongues 32 act as one-way clutches allowing the conductor ends to be inserted but not withdrawn while making electrical contact with such bare conductor ends. A cover 34 of insulating material covers the back of the body 12 and is held in place by a staple 36.

A ballast 40, coupled to the lines 38 from a 120 Volt AC supply 37 at one end, is coupled to shunt 26A which spans lamp pin contacts 18A, 18B and shunt 26B which spans lamp pin contacts 18C, 18D as shown in FIG. 2. Within the fluorescent lamp 42 tube, at one end thereof is a filament 44 connected across lamp pin contacts 18A, 18B and at the other end is a filament 46 connected across lamp pin contacts 18C, 18D.

To use the lampholder 10, a fluorescent lamp (not shown) would be turned so that its lamp pins at one end are positioned one above the other and the lamp pins made to enter slot 16 and moved towards the bottom of body 12. Once the lamp pins are aligned with the channel 14, the lamp is rotated until each of the lamp pins enters the notch 22 of its associated lamp pin contact 18. The tapered lead-ins to each of the notches 22 from above and below assure that the lamp pins enter the notches 22. The resilience and shape of the portion 20 allows the portion 20 to be deflected as the lamp pins move into position in the notches 22 and return to grip the lamp pins once they are in their associated notches 22. A similar lampholder 10 is positioned at the opposite end of the lamp to engage the lamp pins thereat.

With further improvements to the lamp and electronic ballast no filament is needed. Currently, fluorescent lamps are manufactured to work in either a hot cathode mode or a cold cathode mode.

SUMMARY OF THE INVENTION

The instant invention overcomes the difficulties noted above with respect to prior art cold cathode fluorescent lamp lampholders by eliminating the shunt and by eliminating one electrical lamp pin contact in the lampholder while retaining the ability to mechanically support the fluorescent lamp and couple it to a source of AC electrical power. This further negates the belief of evenly dispersed voltage across the filament. To retain the fluorescent lamp in place one of the customary lamp pin contacts is replaced in each of the lampholders with one or more resilient retaining arms to engage one of the fluorescent lamp pins. The other of the two lamp pins is engaged by the notch of an associated lamp pin contact. The resilient retaining arms also insure that the other lamp pin will remain seated in the notch of the lamp pin contact. The retaining arm may be made of an insulating material or fabricated of a material and in a form such that it provides its own spring forces or is provided with suitable spring members. It may also be fabricated of metal strips or metal spring stock to provide the desired spring forces. However, the retaining arm is not connected to a source of AC power.

A compression spring member may also be used to urge an electrical contact member into contact with both of the lamp pins of an inserted fluorescent lamp; This spring member is coupled to a contact to which an electrical conductor may be fastened to provide electrical power to the lamp. The compression spring may be compressed to initially place the lamp in the lampholder and thereafter allowed to expand to maintain the contact between the lamp pins of the lamp and the contact. It is an object of the invention to provide a lampholder for fluorescent lamps.

It is an object of the invention to provide a lampholder for cold cathode fluorescent lamps.

It is an object of the invention to provide a lampholder for cold cathode fluorescent lamps which operate with high-voltage electronic ballasts.

It is still a farther object of the invention to provide a lampholder for cold cathode fluorescent lamps which is simpler and has fewer parts than prior art fluorescent lampholders.

It is yet another object of the invention to provide in one form a lampholder for fluorescent lamps which eliminates the shunt member and replaces one conductive pin engaging assembly with a lamp retaining device which carries no current and in another, uses a spring operated plunger to retain the lamp.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
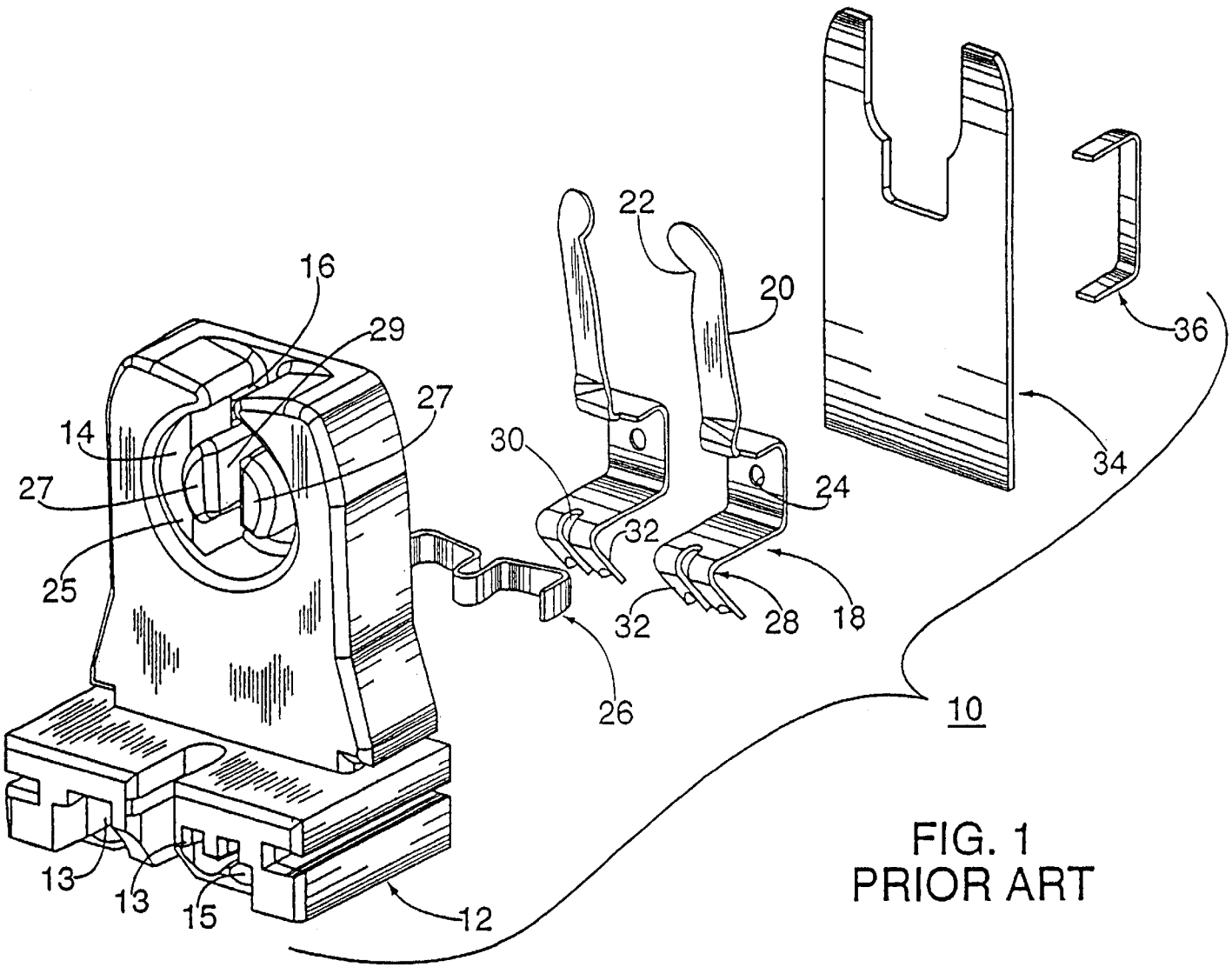
FIG. 1 PRIOR ART
FIG. 1 is an exploded, lower left front perspective view of a fluorescent lampholder constructed in accordance with the teachings of the prior art.
Figure 2:
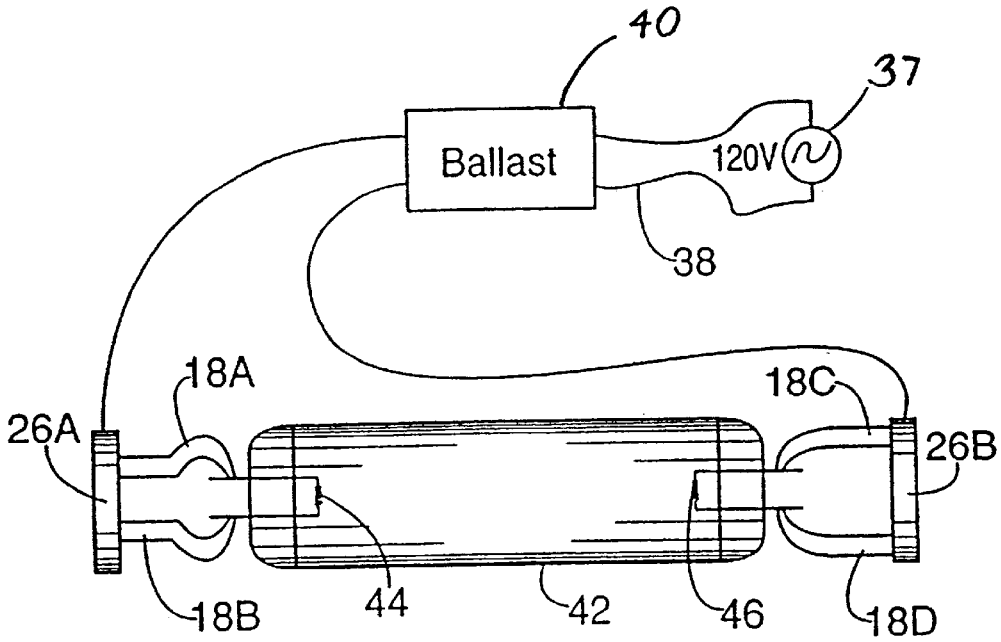
FIG. 2 PRIOR ART
FIG. 2 is a schematic, wiring diagram of the device of FIG. 1.
Figure 4:
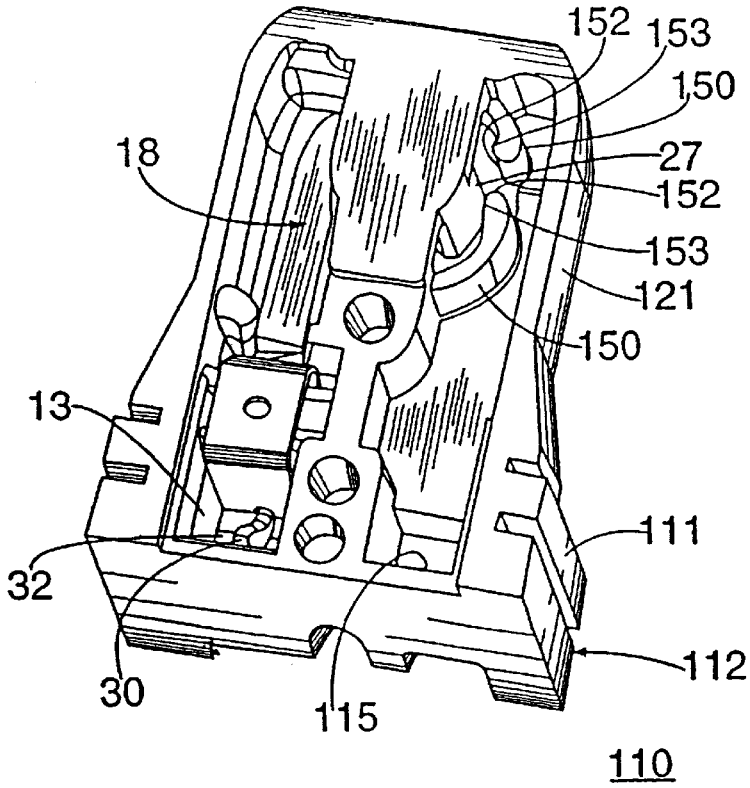
FIG. 4 is an upper left, perspective view of the back of the housing of FIG. 3 with the back cover removed so that the details of a lamp retaining device therein can be appreciated.
Figure 3:
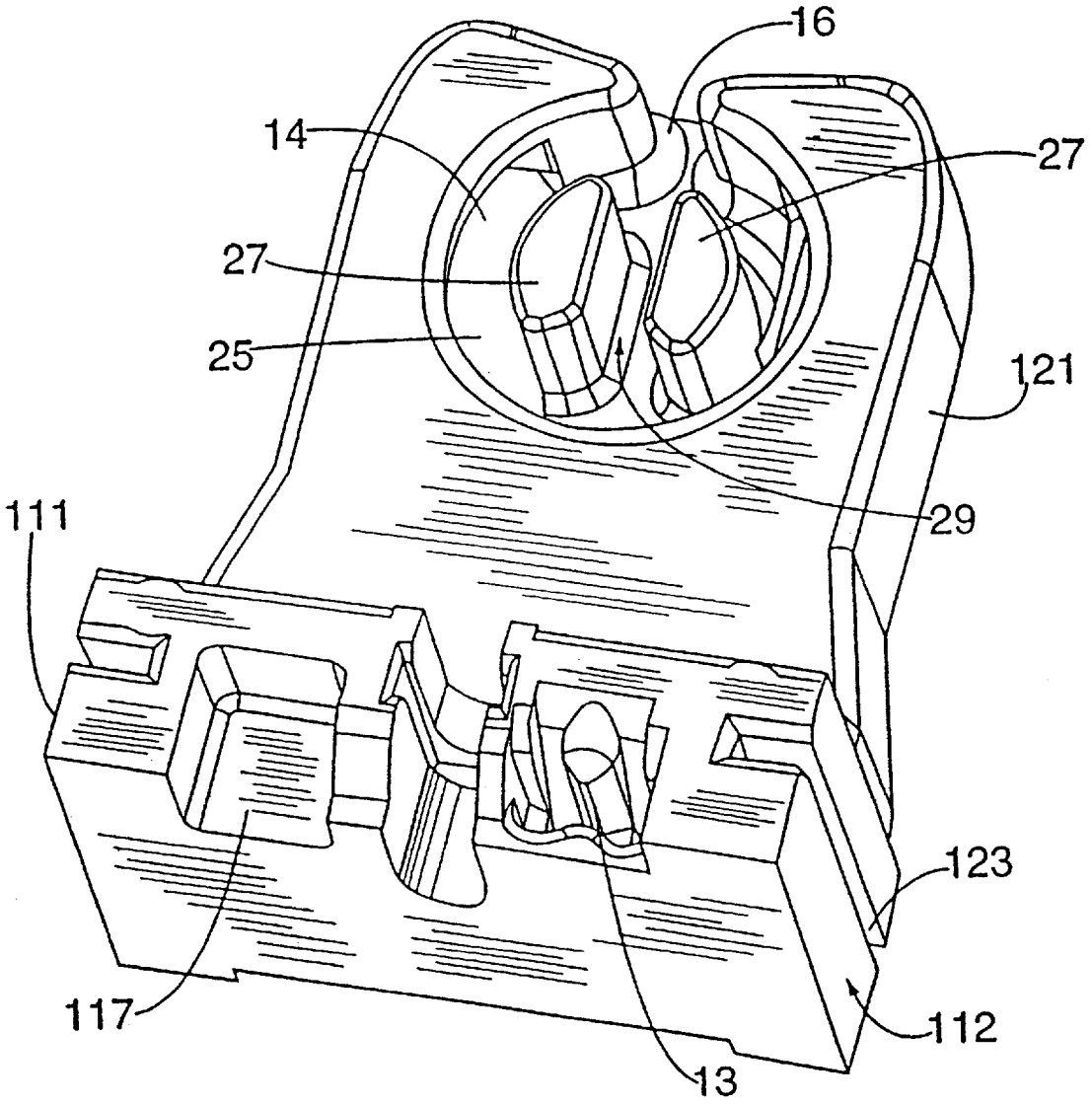
FIG. 3 is an upper left, perspective view of the front of a lampholder housing of the instant invention.

Turning now to FIGS. 1, 3 and 4, the details of the fluorescent lampholder 110 can be described. Body 112 is similar to body 12 except that lower body portion 111 has only one wire lead entrance 13 as compared to the two wire lead entrances 13 of the lampholder 10 of FIG. 1. Bodies 12 and 112 are fabricated by molding or casting from insulating materials such thermosetting or thermoplastic materials, Bakelite or the like. Each wire lead entrance 13 receives the two cantilever tongues 32 of a single lamp pin contact 18. The ends of the tongues 32 rest against the floor 15 of the wire lead entrance 13 and act as one way clutches. The bared end of an insulated conductor (not shown) is advanced along the floor 15 of wire lead entrance 13 and displaces the tongue 32 away from floor 15 and thus establishes electrical contact. Any attempt to withdraw the conductor causes the edge of tongue 32 to bite into the bared metal of the conductor and prevent withdrawal of such conductor. The two tongues 32 permit multiple conductors to be used, as in daisy-chain wiring of multiple lampholders. The second position in body 112 for a wire lead entrance is covered as at 117 (see FIG. 3). A set of slots 123, one on each side of lower body portion 111 permits the lampholder 110 to be mounted in a fixture, housing or the like (not shown).

Upper body portion 121 has a central cavity 25 which contains a central hub 27 to define the channel 14 thereabout. The diameter of the central hub 27 is slightly less than the spacing between the two lamp pins at each end of the fluorescent lamp. Central hub 27 has a medial slot 29 in line with slot 16. The installation of a fluorescent lamp (not shown) to the lampholder. 110 would proceed as follows. The lamp is rotated until both of its lamp pins are aligned with slots 16 and 29. The lamp is now lowered into the lampholder 1 10 until the lamp pins are positioned in diametrically opposed positions just beyond the periphery, of central hub 27. The lamp is now rotated to a position where the lamp pins of the lamp are transverse to the slot 29. In the prior art device of FIG. 1, the lamp pins each come to rest in the notches 22 of one of the lamp pin contacts 18. The same thing occurs at the opposite end and the fluorescent lamp is now connected and supported.

Figure 5:
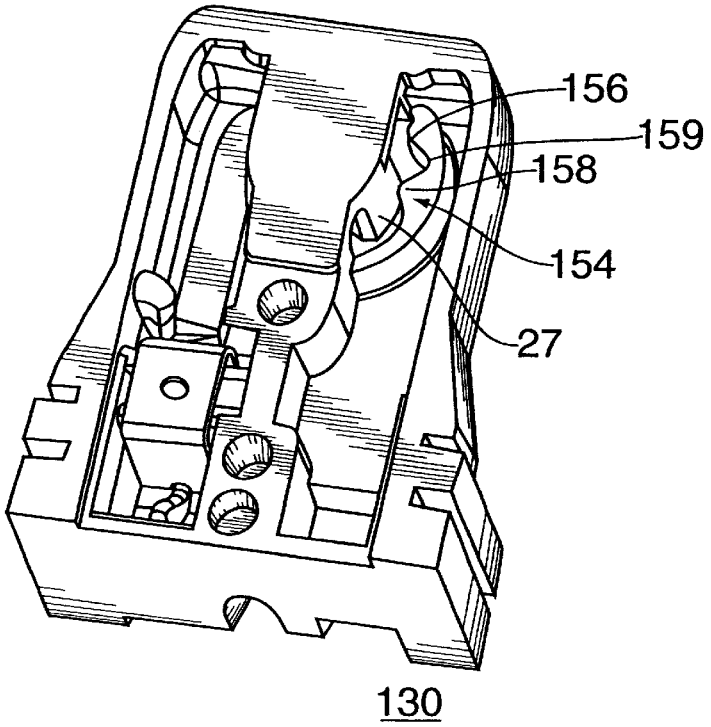
FIG. 5 is an upper left, perspective view of the back of the housing as shown in FIG. 4 showing a different form of lamp retaining device.

In the lampholder 110 of FIG. 4, one of the lamp pins engages a lamp pin contact 18 and is seated in its notch 22 (not visible) as is true of the prior art devices of FIG. 1. Thus, there is the desired electrical contact between the bared end of an electrical conductor (not shown) inserted in wire entrance 13 and one lamp pin of the fluorescent lamp at each end. The support of the fluorescent lamp at each end may be provided by the device of FIG. 4 or the other devices disclosed herein and described below. Two cantilever mounted arms 150 are mounted adjacent the outer periphery of the left segment of hub 27 at each end of the fluorescent lamp to grip the other lamp pin between the rounded leading edges 152 of the arms 150. The displacement lobes 153 when engaged by the fluorescent lamp pin as it is turned in the channel 14 causes the outward defection of the arms 150 to permit the lamp pin to be positioned between the rounded leading edges 152 as the arms 150 return to their initial position after the lamp passes the lobes 153. FIG. 5 shows a lampholder 130 which employs a single cantilever mounted arm 154 with two displacement lobes 156 and 158 which causes the outward deflection of arm 154 as the lamp pin is rotated into position adjacent the outer surface of hub 27 and permit the arm 154 to return to its initial position once the lamp pin is positioned in recess 159. Thus, the fluorescent lamp pins are held between notch 22 of a lamp pin contact 18 and recess 159 of arm 154.

Figure 6:
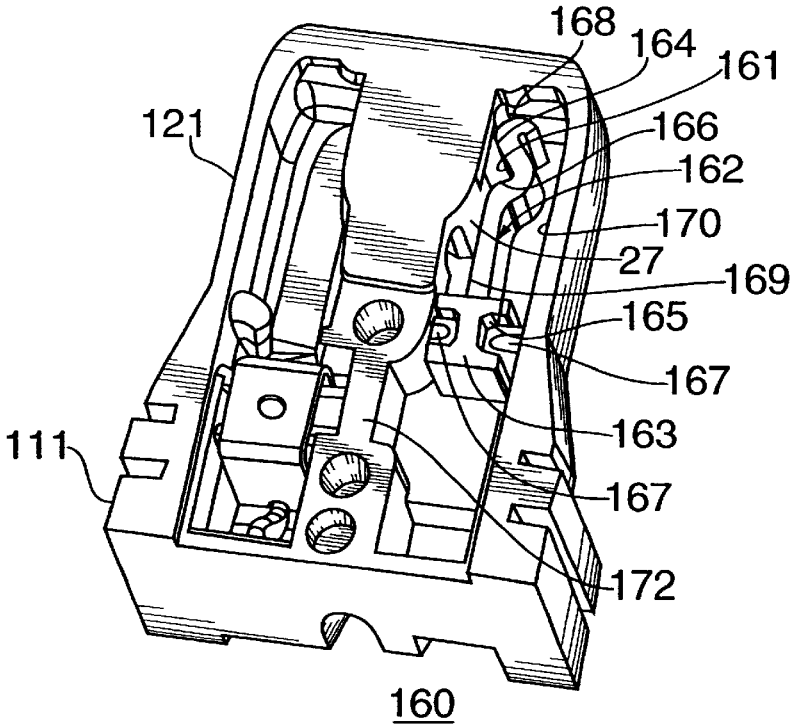
FIG. 6 is an upper left, perspective view of the back of the housing as shown in FIG. 4 showing yet another form of lamp retaining device.

FIG. 6 shows a lampholder 160 which also employs a single cantilever mounted arm 162 which engages a lamp pin of an inserted fluorescent lamp in a recess 161 between two displacement lobes 164 and 166. The leading edge 168 when engaged by a lamp pin deflects the arm 162 outwardly away from hub 27. The engagement of a lamp pin with the portion 169 of the arm 162 similarly deflects the arm 162. The arm 162 returns to its initial position once the lamp pin is within recess 161. The arm 162 has a base 163 with slots 165 in its sides which engage the tabs 167 formed on the inside surface 170 of the wall defining upper body portion 121 and a central interior wall 172.

Figure 7:
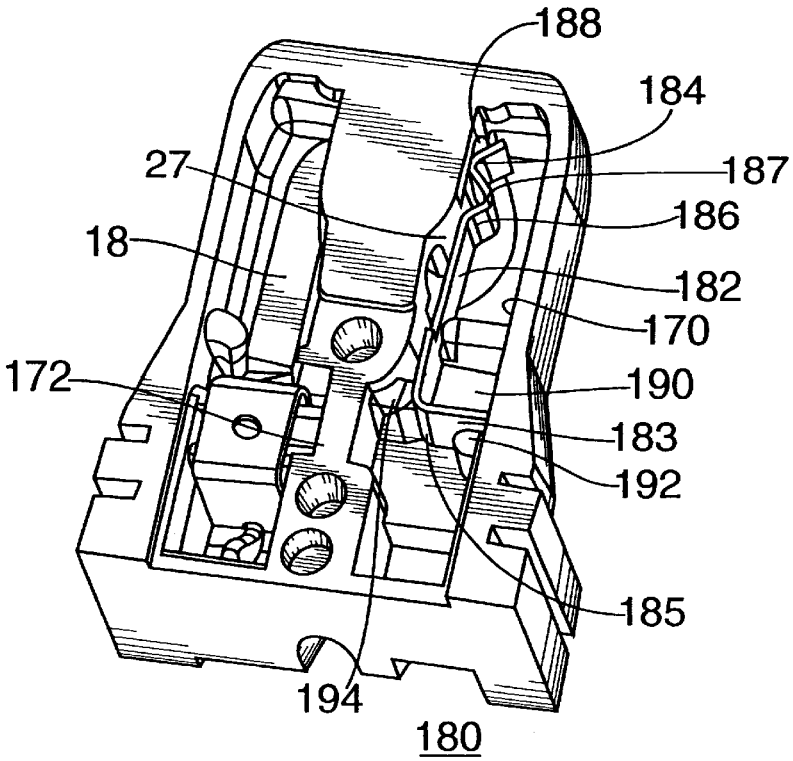
FIG. 7 is an upper left, rear perspective view of the back of the housing as shown in FIG. 4 showing still a further form of lamp retaining device.

In FIG. 7, a lampholder 180 is shown which uses a single cantilever mounted arm 182 similar to arm 162 but made of metal spring stock instead of molded of a plastic or rubber material. Arm 182 has displacement lobes 184 and 186 with a recess of 187 therebetween. Depending upon the direction in which the fluorescent lamp is turned as the lamp pins are moved into channel 14, the engagement between a lamp pin and one of the lobes 184 and 186 causes the arm 182 to be outwardly deflected away from the surface of hub 27. When the lamp pin is positioned in the entrance to recess 187, the arm 182 is permitted to return to its initial position with the lamp pin fully in recess 187. The lead-in 188 and the arm 182 itself provide for the displacement of the-arm 182 by engagement with a rotating lamp pin. The end section 183 of arm 182 is positioned between raised pad 190 and tab 192 on the interior surface 170 of the wall defining upper body portion 121. Adjacent the knee 185 of arm 182 is a pad 194 on the central interior wall 172. Since the arm 182 is not connected to a power supply conductor, it does not electrically affect the fluorescent lamp inserted into the lampholder 180.

Figure 8:
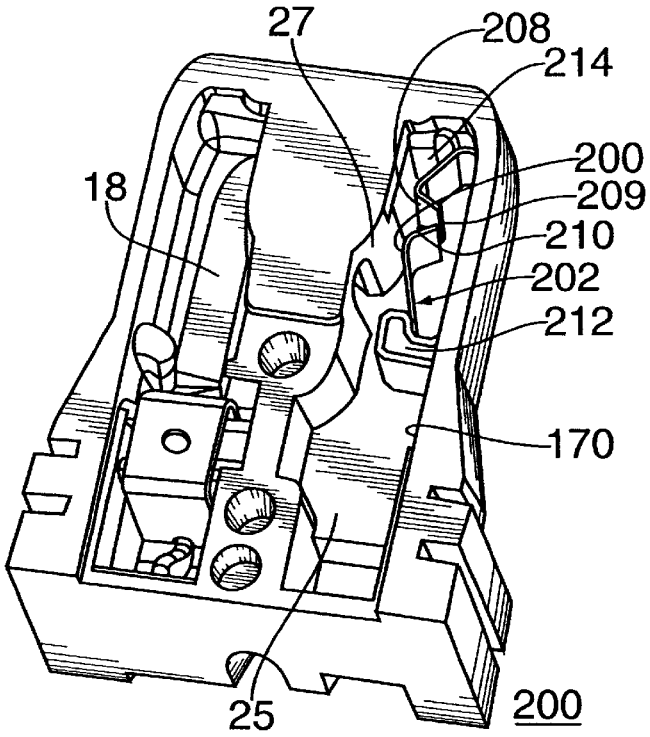
FIG. 8 is an upper left, perspective view of the back of the housing as shown in FIG. 4 showing yet another form of lamp retaining device.
Figure 9:
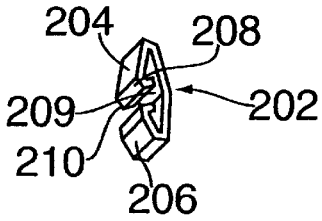
FIG. 9 is an upper right, perspective view of the lamp retaining device of FIG. 8.

A substantially closed spring metal band 202 (see FIGS. 8 and 9) is used in place of the cantilever mounted displaceable arms 162 of FIG. 6 and 182 of FIG. 7. Metal band 202 has two linear, inclined sections 204,206 whose end portions are bent inwardly with radiused bends to form displacement lobes 208 and 210, respectively, with a recess 209 between them. The ends of the lobes 208 and 210 grip the lamp pin in the recess 209. The band 202 is placed on a shelf 212 on interior wall 170 and against a block 214 on the roof of chamber 25. The lamp pin displaces the ends of the band 202 by contact with displacement lobes 208,210 until the pin rests in the recess 209 and is engaged by the ends of the band 202.

Figure 10:
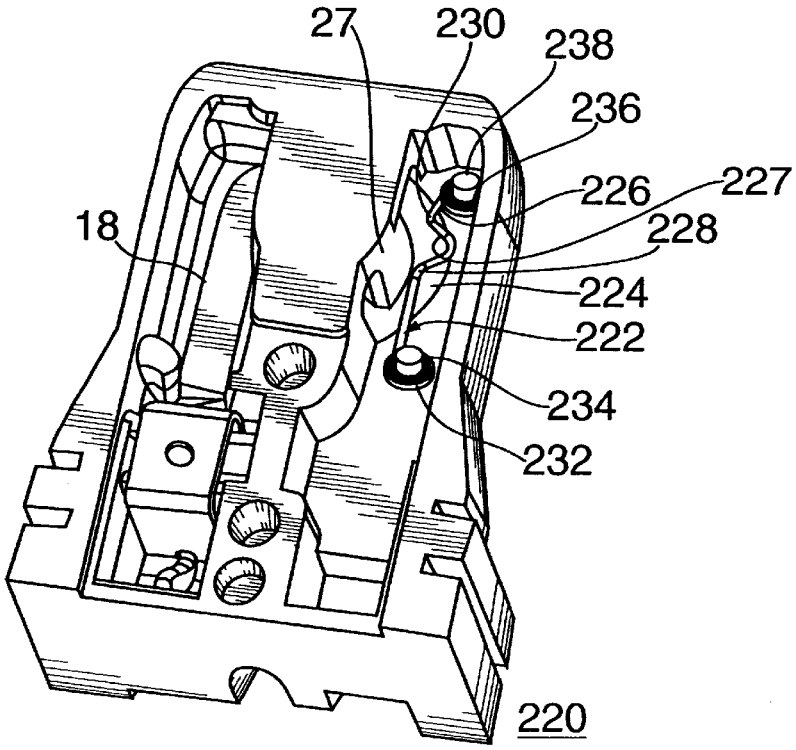
FIG. 10 is an upper left, perspective view of the back of the housing as shown in FIG. 4 showing another form of lamp retaining device.

A length of resilient wire is used as the lamp retaining arm 222 in the lampholder 220 shown in FIG. 10. The arm 222 has a first linear portion the end portion 232 of which is wound about a post 234 and the other end of which is bent at an acute angle to give a displaceable lobe 228. A second linear portion 226 has an end 236 wrapped about a post 238 and a second end bent to form a displacement lobe 230. A pin recess 227 is formed between lobes 228 and 230. Arm 222 is displaced by the lamp pin engaging either of the lobes 228,230 and returns to its initial condition once the lamp pin enters recess 227.

Figure 11:
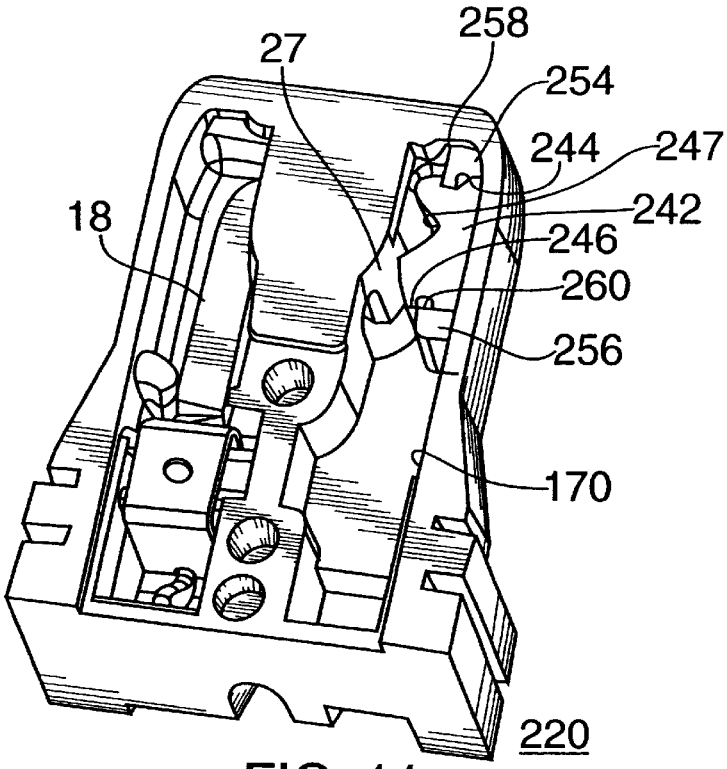
FIG. 11 is an upper left, perspective view of the back of the housing as shown in FIG. 4 showing a further form of lamp retaining device.
Figure 12:
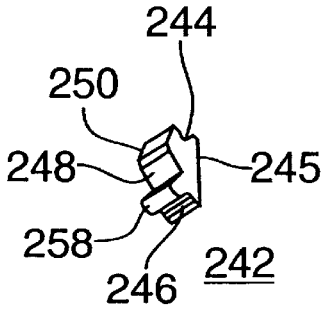
FIG. 12 is a lower left, perspective view of the lamp retaining device of FIG. 11.

A different type of lamp retainer device is shown in FIGS. 11 and 12. The lampholder 240 makes use of a lamp retaining device 242 made of a compressible material which is compressed when the lamp is installed and expands thereafter to grip the lamp pins. The device is generally K-shaped and has slots 244 and 246 in it shorter marginal faces to leave a vertical bar 245 along its back face. A V-notch 248 is formed in the front face providing a pin recess 247. The remaining portions of the front face provide lead-in surfaces 250,252. The inner wall 170 is formed with two L-shaped arms 254,256 the shorter member of each 258,260, respectively, facing one another. The device 242 is positioned with member 258 in slot 244 and member 260 in slot 246. The lamp pin when it contacts lobes 250 and 252 compresses the lobe until the pin enters recess 247 at which time the compressed lobe 250 and 252 expands to hold the lamp pin in the recess 247.

Thus, there have been shown resilient lamp retainer devices which cooperate with lamp pin contacts to support a fluorescent lamp in a lampholder. These devices may be cantilever mounted arms of plastic or spring metal, flat spring metal or spring wire forms or compressible material. The devices are displaced in some manner as the lamp is installed and then return to securely grip a lamp pin.

Turning now to FIGS. 13 to 20 a further form of lampholder 300 for fluorescent lamps and employing a single element to engage both lamp pins contact is disclosed. The body 302 has bore 304 from front face 306 to a generally open parallel rear face 308. The bore 304 is enlarged from a point between front face 306 and rear face 308 and extending to rear face 308. The transition from bore 304 to the enlarged bore portion.310 provides a step 312. Placed within bores 304 and 310 is a plunger member 314 having a generally cylindrical shape extending from a front surface 316 to a rear surface 318. Adjacent rear surface 318 is an external annular ring 320 which can engage step 312 to prevent plunger member 314 being drawn out of body 302 through front face 306. Plunger member 314 has a first diameter bore 322 and a larger second diameter bore 324 concentric with the first diameter bore 322 and in communication with it. The transition from bore portion 322 to bore portion 324 produces a step 326.

A rear housing member 330 is joined to body 302 as with threaded fastener 332 to complete the housing of lampholder 300. Rear housing member 330 has an inside surface 334, an outside surface 336, a bottom wall 338 and a side wall 340. A hub 342 projects inwardly from inside surface 334 and is positioned in the upper portion of rear housing member 330. A boss 344 having an aperture 346 allows fastener 332 to pass through rear housing member 330 to mate with a boss on inner surface 309 of body 302 (not shown). A first rib 348 extends between hub 342 and boss 344 and a second rib 350 extends between boss 344 and bottom wall 338. A cantilevered extension 352 of second rib 350 extends at an angle to the longitudinal axis of the rear housing member 330. A second hub 354 extends between the main portion of second rib 350 and the extension 352. An opening 356 in bottom wall 338 provides access to the region of the rear housing member adjacent extension 352.

A first electrical contact 360 is made of a resilient, flexible metal such as copper, a copper alloy such as beryllium copper or the like. A first contact portion 362 is bent at an acute angle from the longitudinal axis of first electrical contact 360 for engagement with a portion of the outer surface of hub 342 and with the last turn 374 of compression spring 370. A bridge portion 364 of contact 360 permits the contact 360 to pass around a portion of the surface of boss 344. Tongue 368 is formed by bending contact 360 as at 366 to an acute angle to the longitudinal axis of contact 360. When contact 360 is assembled to rear housing member 330, the bend 366 will extend between hub 354 and the joiner of second rib 350 and extension 352. Tongue 368 will operate in the same manner as tongues 32 described above with respect to FIG. 1. An insulated conductor 380 having a portion of the insulation removed to expose the central conductor 382 is inserted through opening 356 in bottom wall 338 and between the free edge of tongue 368 and the inside of side wall 340.

A second electrical contact 390 in the form of a thin metal disk is proportioned to fit within bore portion 324 in plunger 314 and comes to rest against step 326, thus bridging bore 322. In this manner the two lamp contact pins 274 of an end cap 272, on either end of fluorescent lamp 270 can be engaged at the same time.

A compression spring 370 extends from a first turn 372 to a last turn 374. The last turn 374 fits over a portion of the outer surface of hub 342 and engages first contact portion 362 of first contact 360. The first turn 372 engages the second contact 390. Accordingly, a current path is established from a power supply conductor 380, whose bared central conductor 382 engages tongue 368 of first contact 360, through first contact 360 to the last turn 374 of compression spring 370, the compression spring 370 itself to the second contact 390, because of the engagement of first turn 372 with second contact 390, to the lamp pins 274 of an inserted lamp 270.

In order to use lamp holder 300, the contact pins 274 of one end of the lamp 270 must be placed in a fixed lampholder (not shown). The plunger 314 is depressed into the body 302 so that the lamp pins 274 at the opposite end of lamp 270 can enter bore 322. The compression spring 370 is compressed. Once the lamp pins 274 are in place, the plunger 314 is released and the expanding spring 370 pushes the front face 316 of plunger 314 towards end cap 272 and causes second contact 390 to engage the lamp pins 274. To remove lamp 270, the plunger 314 must be depressed.

Figure 13:
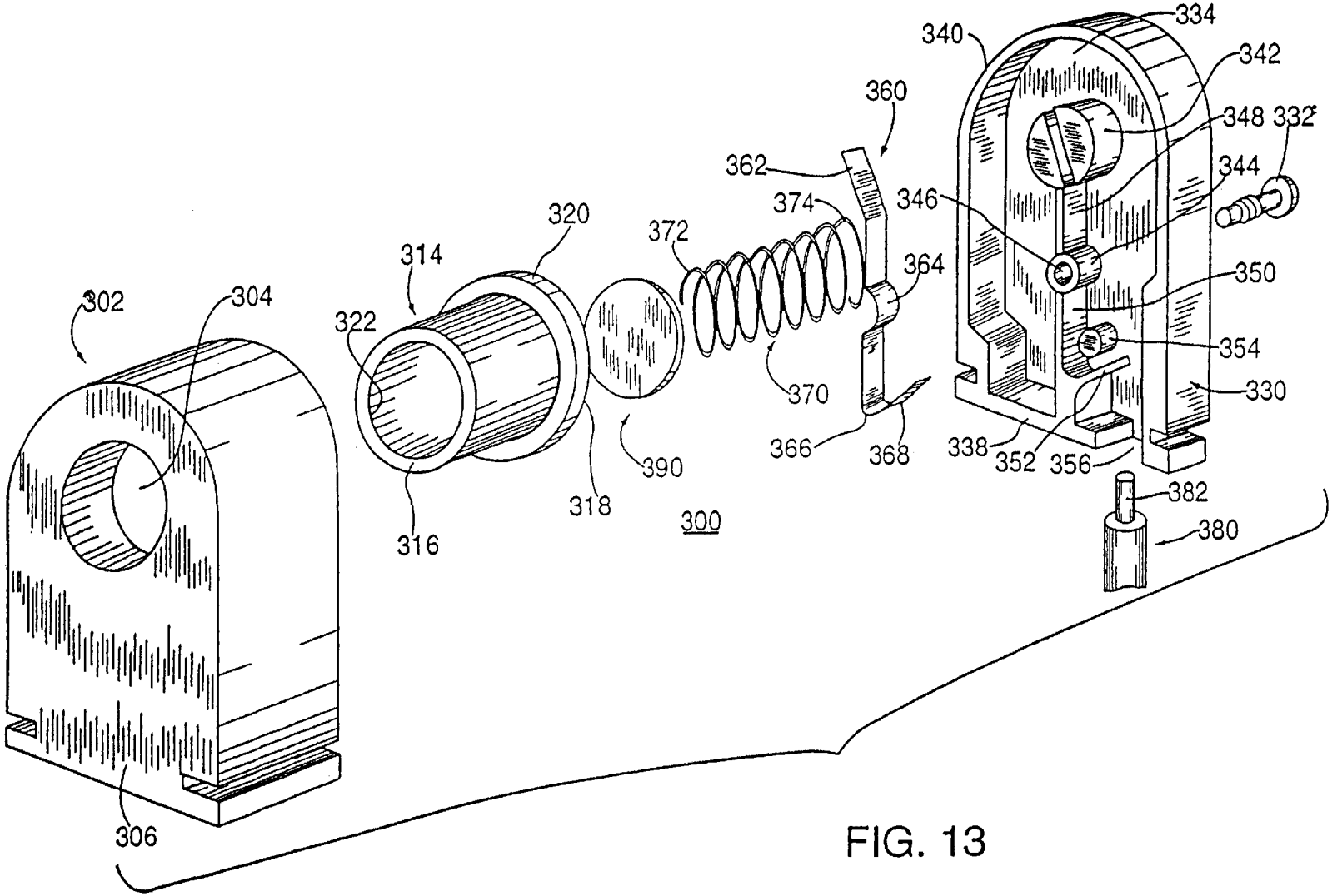
FIG. 13 is an exploded, lower left front perspective view of a further form of fluorescent lampholder constructed in accordance with the concepts of the invention.
Figure 14:
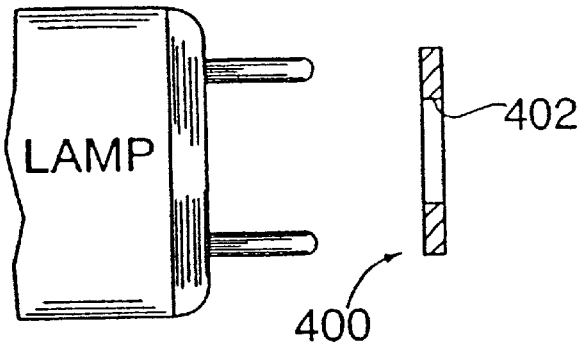
FIGS. 14 to 18 show alternative forms of the contact member shown in FIG. 13.
Figure 15:
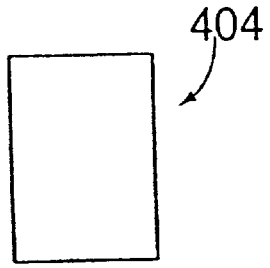
Figure 16:
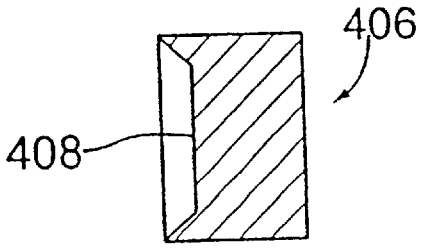
Figure 17:
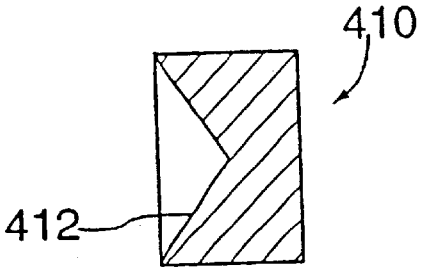
Figure 18:
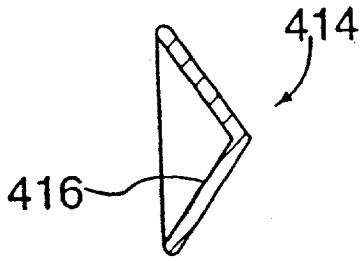
Figure 19:
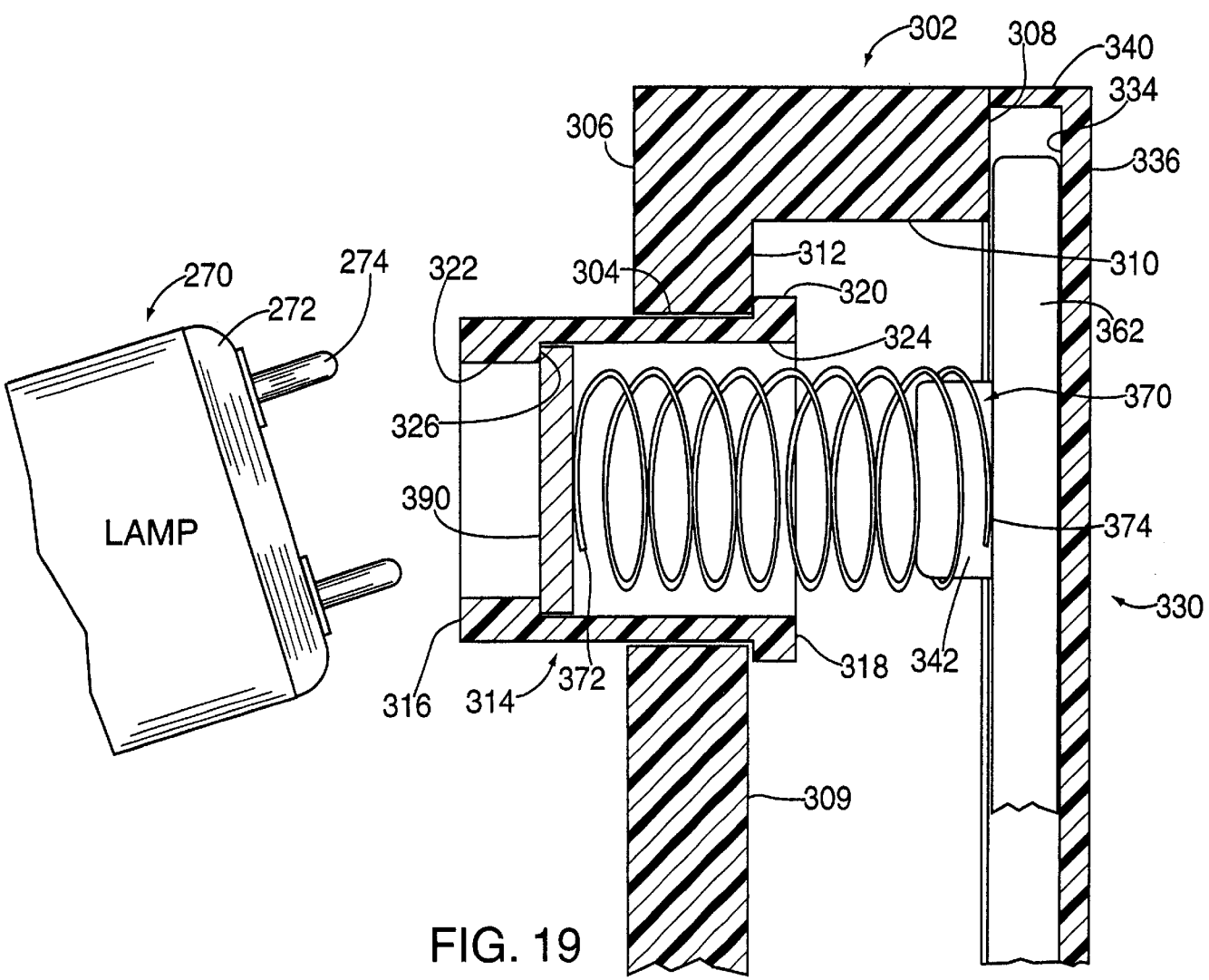
FIG. 19 is a fragmentary, side elevational view, partly in section, showing the assembled components of FIG. 13 in a position to install or remove a fluorescent lamp.
Figure 20:
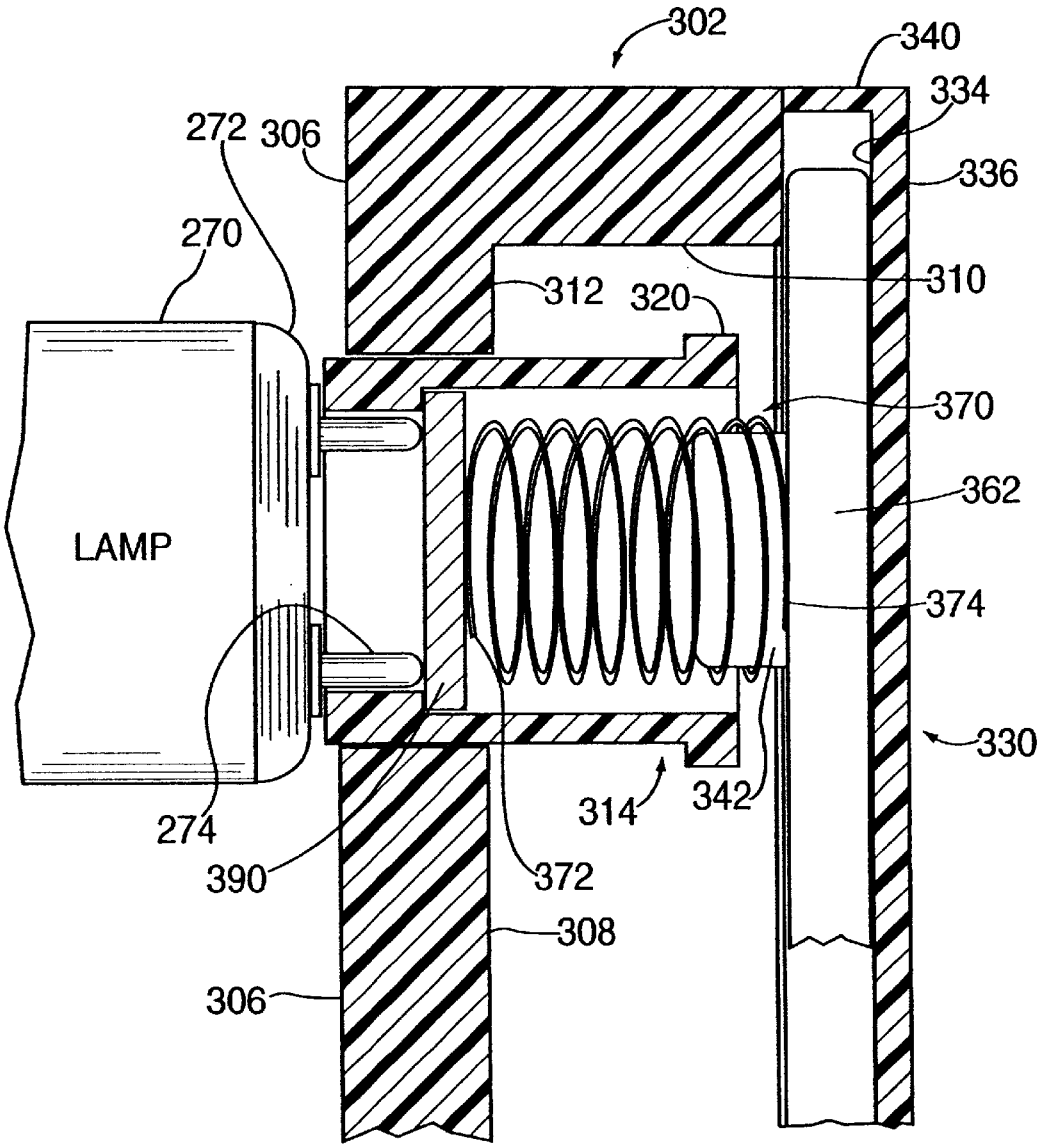
FIG. 20 is a fragmentary, side elevational view, partly in section, showing the assembled components of FIG. 13 once a fluorescent lamp has been properly seated in the lampholder.

The second contact 390 shown in FIGS. 13, 19 and 20 is a thin, flat circular disk but may take other shapes and dimensions. FIG. 14 shows a second contact 400 which is thin, flat, circular disk with a central aperture 402 therethrough. The aperture 402 has a width such that remainder of disk 400 can engage both lamp pins at one end of a lamp. The second contact can be a thick, flat, circular disk 404 as shown in FIG. 15. The faces of disk 404 are plane but may have a pocket or indentation extending inwardly from one face as shown by indentation 408 in contact 406 shown in FIG. 16 or conical indentation 412 in contact 410 as shown in FIG. 17. The lamp pins 274 will seat on the inclined or flat surfaces of the disks based upon their relative dimensions due to spring 370. FIG. 18 shows a conical contact 414 with a triangular recess 416.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

We claim:

1. A lampholder characterized by an absence of a plurality of lamp pin contacts for electrically engaging and supporting cold cathode fluorescent lamps, which lamps include an elongated lamp envelope and two opposite end caps, each of the end caps including two lamp pins extending therethrough, the lampholder comprising:

a) an elongated body member formed with a conductor receiving portion and a lamp receiving portion;

b) a single electrically conductive lamp pin contact formed with a first end located in said body member conductor receiving portion for conducting electricity between a power-supplying electrical conductor and one of said lamp pin contacts, and a second end located in said body member lamp receiving portion to engage at least one of said two lamp pins; and c) a lamp retaining device in said body member lamp receiving portion for supporting a second one of the two lamp pins of the fluorescent lamp in electrical contact with said single lamp contact pin;

d) said lampholder characterized by the absence of a need for more than one lamp pin contact as found in conventional fluorescent lampholders requiring two lamp pin contacts thereby eliminating a lamp pin contact to provide a saving in material cost of the lampholder.

2. A lampholder for electrically engaging and supporting cold cathode fluorescent lamps having an elongate lamp envelope and two opposite end caps, each of said two end caps having two lamp pins extending therethrough, the lampholder comprising:

a) an elongate body member having a conductor receiving portion and a lamp receiving portion;

b) an electric lamp pin contact having a first end located in said body member conductor receiving portion for engaging an electrical conductor to supply electrical power to said lamp pin contact and a second end located in said body member lamp receiving portion for engaging one of said two lamp pins; and c) a lamp retaining device in said body member lamp receiving portion for engaging the other of said two lamp pins whereby a fluorescent lamp will be supported between said electrical lamp pin contact and said lamp retaining device.

3. A lampholder as defined in claim 2, wherein said lamp retaining device comprises at least one cantilever mounted arm.

4. A lampholder as defined in claim 2, wherein said lamp retaining device comprises two cantilever mounted arms.

5. A lampholder as defined in claim 3, wherein said at least one cantilever mounted arm is mounted concentrically with said lamp pin when a fluorescent lamp is placed adjacent in said body member lamp receiving portion.

6. A lampholder as defined in claim 4, wherein said cantilever mounted arms are mounted concentrically with said lamp pin when a fluorescent lamp is placed adjacent said body member lamp receiving portion.

7. A lampholder as defined in claim 3, wherein each of said at least one cantilever mounted arms has an interior surface with at least one displacement lobe to engage said lamp pin when a fluorescent lamp is placed adjacent said body member lamp receiving portion.

8. A lampholder as defined in claim 4, wherein each of said two cantilever mounted arms has one displacement lobe at its free end.

9. A lampholder as defined in claim 2, wherein said lamp retaining device is a single cantilever mounted arm extending tangentially to the outer surface of said lamp envelope when a fluorescent lamp is placed adjacent said body member lamp receiving portion.

10. A lampholder as defined in claim 9, wherein said single cantilever mounted arm is fabricated from flat, resilient metal stock.

11. A lampholder as defined in claim 10, wherein said single cantilever mounted arm has one displacement contact lobe formed thereon to engage said lamp pin when a fluorescent lamp is placed adjacent said body member receiving portion.

12. A lampholder-as defined in claim 2, wherein said lamp retaining device is a substantially closed deflectable member mounted radially with respect to said lamp envelope when a fluorescent lamp is placed adjacent said body member lamp receiving portion.

13. A lampholder as defined in claim 12, wherein said substantially closed deflectable member is fabricated from flat, resilient metal stock.

14. A lampholder as defined in claim 13, wherein said substantially closed deflectable member has two displacement lobes formed thereon to engage said lamp pin envelope when a fluorescent lamp is placed adjacent said body member lamp receiving portion.

15. A lampholder as defined in claim 2, wherein said lamp retaining device is a single member mounted to said body member and extending tangentially to the outer surface of said lamp envelope when a fluorescent lamp is placed adjacent said body member lamp receiving portion.

16. A lampholder as defined in claim 15, wherein said single member is fabricated from resilient spring wire.

17. A lampholder as defined in claim 16, wherein said single member has two displacement lobes formed thereon to engage said lamp pin when a fluorescent lamp is placed adjacent said body member lamp receiving portion.

18. A lampholder as defined in claim 2, wherein said lamp retaining device is a single member mounted radially with respect to said lamp envelope when a fluorescent lamp is placed adjacent said body member lamp receiving portion.

19. A lampholder as defined in claim 18, wherein said single member is fabricated from compressible material.

20. A lampholder as defined in claim 19, wherein said single member has two displacement lobes formed thereon to engage said lamp piss when a fluorescent lamp is placed adjacent said body member lamp receiving portion.

21. A lampholder for electrically engaging and supporting cold cathode fluorescent lamps having an elongate lamp envelope with two opposite end caps, each of said two end caps having two lamp pins extending therethrough, the lampholder comprising:

a) an elongate housing member having a conductor receiving portion and a lamp receiving portion;

b) a first contact member having a first end located in said housing member conductor receiving portion for engaging an electrical conductor to supply electrical power to said first contact member and a second end located in said lamp receiving portion of said housing member;

c) a second contact member having a first conductive surface with at least one depression therein adapted to engage both of the lamp pins of one of said two end caps with both of the lamp pins seated within the trough of the respective depression; and d) spring means coupled at a first end to said second contact member and at a second end to said second end of said first contact member, said spring means fabricated from a conductive material whereby the electrical power applied to said first contact member is also applied to said second contact member and to the two lamp pins of a fluorescent lamp inserted adjacent said lamp receiving portion of said elongate housing member.

22. A lampholder, as defined in claim 21, further comprising:

a) a first partial housing member having an inside surface and an outside surface; and b) a hub on the inside surface of said first partial housing member to receive thereon said second end of said first contact member and thereabout said second end of said spring means to establish a conductive path between said first and second contact members.

23. A lampholder, as defined in claim 22, further comprising:

a) a second partial housing member having an inside surface and an outside surface, and an aperture extending through said outside and inside surfaces of said second partial housing member, said aperture being so dimensioned that the lamp pins of one end cap of a fluorescent lamp can pass therethrough; said aperture being in alignment with said hub; and b) said second partial housing member and said first partial housing member capable of being assembled to form a complete housing member to contain said first and second contact members and said spring means therein.

24. A lampholder, as defined in claim 21, wherein the first surface of said second contact member is a flat round disk having the depression therein to engage and seat the two lamp pins.

25. A lampholder, as defined in claim 21, wherein the first surface of said second contact member is a conical surface with the extent of the conical surface forming the at least one depression in a first surface, with the extent of the conical surface facing the two lamp pins to engage and seat the two lamp pins extending through one of the two end caps.

26. A lampholder, as defined in claim 21, wherein said second contact member is a solid cone having an inner conical surface with the extent of the conical surface forming the at least one depression in a first surface, with the extent of the inner conical surface facing the two lamp pins to engage and seat the two lamp pins extending through one of the two end caps.

27. A lampholder electrically engaging and supporting cold cathode fluorescent lamps having an elongate lamp envelope with two end caps, one at each end of said lamp envelope, each of said two end caps having two lamp pins extending therethrough, the lampholder comprising:

a) an elongate housing member having a conductor receiving portion and a lamp receiving portion;

b) a contact member having a first end located in said conductor receiving portion of said housing member and a second end located in said lamp receiving portion of said housing member;

c) said contact member first end engaging an electrical conductor to supply electrical power to said contact member; and d) said contact member second end formed to engage two contact pins of a fluorescent lamp inserted into said housing member.

28. A lampholder, as defined in claim 23, further comprising:

a) plunger means having a cylindrical outer surface and a cylindrical, central bore extending from a first end to a second end, said bore being enlarged from a position intermediate said first and second ends to said second end to form a step where said central bore and said enlarged bore meet; said plunger means having an annular rib about the cylindrical outer surface adjacent said second partial housing member to prevent said plunger means passing completely through said aperture in said second partial housing member;

b) said second contact member positioned in said enlarged bore against said step to engage both the contact pins of one of said two end caps;

c) said spring means engaging at a first end said second contact means to urge said second contact means to engage the two pins of one of said two end caps; and d) said spring means second end wrapped about said hub to fix the position of said spring means and urge said second contact member into contact with both of the contact pins of one of said two end caps.

29. A lampholder for electrically engaging and supporting cold cathode fluorescent lamps having an elongate lamp envelope with two end caps, one at each end of said lamp envelope, each of said two end caps having two lamp pins extending therethrough, the lampholder comprising:

a) an elongate body member having a conductor receiving portion and a lamp receiving portion;

b) an electrical lamp pin contact having a first end located in said body member conductor receiving portion for engaging an electrical conductor to supply electrical power to said lamp pin contact and a second end located in said body member lamp receiving portion to engage at least one of said two lamp pins; and c) a lamp retaining device in said body member lamp receiving portion for engaging a fluorescent lamp pin whereby said fluorescent lamp is supported by said lamp retaining device and in contact with said electrical lamp pin contact.

* * * * *